US008398211B2

(12) United States Patent
Shimamura

(10) Patent No.: US 8,398,211 B2
(45) Date of Patent: Mar. 19, 2013

(54) LIQUID-EJECTING RECORDING HEAD HAVING AN ELEMENT THAT GENERATES ENERGY AND METHOD OF PRODUCING THE SAME

(75) Inventor: Ryo Shimamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 12/906,015

(22) Filed: Oct. 15, 2010

(65) Prior Publication Data

US 2011/0122202 A1 May 26, 2011

(30) Foreign Application Priority Data

Nov. 25, 2009 (JP) ..... 2009-267729

(51) Int. Cl.
*B41J 2/05* (2006.01)

(52) U.S. Cl. ..... 347/58; 347/50

(58) Field of Classification Search ..... 347/20, 347/50, 56–58, 61–65, 67
See application file for complete search history.

(56) References Cited

U.S. PATENT DOCUMENTS 6,084,612 A * 7/2000 Suzuki et al. ..... 347/50
6,099,109 A * 8/2000 Komuro ..... 347/50
6,471,901 B1 10/2002 Kawamura et al.

FOREIGN PATENT DOCUMENTS

JP 3592172 B2 11/2004

* cited by examiner

*Primary Examiner* — Juanita D Jackson
(74) *Attorney, Agent, or Firm* — Canon U.S.A., Inc. IP Division

(57) ABSTRACT

A method of producing a recording head including a substrate provided with an element that generates energy utilized for ejecting a liquid, a wiring member that is connected to the substrate, and a supporting member that supports the substrate and the wiring member includes applying a sealant to a region existing between a side surface of the substrate and the supporting member through a communicating path that connects the region to an outer peripheral area of the supporting member.

6 Claims, 10 Drawing Sheets

LIQUID-EJECTING RECORDING HEAD HAVING AN ELEMENT THAT GENERATES ENERGY AND METHOD OF PRODUCING THE SAME

BACKGROUND OF THE INVENTION

1. Field of the Invention

The present invention relates to a recording head that discharges a liquid, more particularly ink as a recording liquid used to perform recording in a recording medium in the form of droplets. The present invention also relates to a method of producing the liquid-ejecting recording head.

2. Description of the Related Art

An existing liquid-ejecting recording head and a configuration of major components of the liquid-ejecting recording head will be described by referring to FIGS. 10A and 10B. FIG. 10A is a perspective view of the liquid-ejecting recording head, and FIG. 10B is an exploded perspective view illustrating the configuration of the major components of the liquid-ejecting recording head. In FIGS. 10A and 10B, the liquid-ejecting recording head includes a recording element substrate 200 that discharges a liquid (ink) and an electrical wiring member 300 that provides electrical connection between the recording element substrate 200 and a recording apparatus and is formed of a flexible material. In addition, the liquid-ejecting recording head includes a tank case 100, to which components such as the recording element substrate 200 and the electrical wiring member 300 are fixed. The tank case 100 holds the ink therein.

In general, to mount the recording element substrate 200 in the electrical wiring member 300, gold-plated bumps are provided on the recording element substrate 200, and then a plurality of leads provided in the electrical wiring member 300 and the plated bumps are electrically joined together in the inner lead bonding (ILB) process. The recording element substrate 200 having been joined to the electrical wiring member 300 in the ILB process is then joined to the tank case 100 by adhesion. After that, an area surrounding the recording element substrate 200 is sealed with a first sealant 400 (hereinafter also referred to as boundary sealing). In addition, since there is a possibility that ink droplets or the like will adhere to an exposed part of electrical connection portions having undergone the ILB process if such an exposed part exists, the electrical connection portions are sealed by coating the electrical connection portions with a second sealant 500 such as an epoxy polymer that has a sealing ability (hereinafter also referred to as ILB sealing). Thus, the first sealant 400 and the second sealant 500 are respectively applied to the area surrounding the recording element substrate 200 and the electrical connection portions including the plated bumps and the leads. Then, the resultant structure is thermally cured and mounted in the liquid-ejecting recording head.

FIGS. 11A to 11C are plan views illustrating a schematic configuration of the major components of the liquid-ejecting recording head. Each of FIGS. 11A, 11B, and 11C illustrates a step in a manufacturing process of the liquid-ejecting recording head. FIG. 11A illustrates the state in which the recording element substrate 200 and the electrical wiring member 300, which have undergone the ILB process, are mounted in the tank case 100. FIG. 11B is a schematic plan view illustrating the state in which the first sealant 400 is applied to the area surrounding the recording element substrate 200 that is mounted in the tank case 100. FIG. 11C illustrates the state in which the second sealant 500 is applied to the electrical connection portions including the gold-plated bumps and the leads. Here, a material generally selected for the first sealant 400 used to seal the area surrounding the recording element substrate 200 has high flowability, and also has low tendency to apply stress due to curing shrinkage or the like to the recording element substrate 200 after the material has been cured. On the other hand, a material of the second sealant 500 used for the ILB sealing is selected by considering durability under use with a wiper blade or the like of a recording apparatus. Normally dispensing is performed so as to supply a desired amount of a sealant to a predetermined position using a three-axis robot having X, Y, and Z axes, a dispenser, syringes, needles and the like.

Boundary sealing as described above is performed as illustrated in FIG. 12. A dispensing end of the needle attached to the syringe in which the first sealant 400 is contained is positioned at A, which exists in a gap between the recording element substrate 200 facing a depression in a supporting member and the electrical wiring member 300. Then, the dispensing end of the needle is moved in a longitudinal direction (from A to A' in FIG. 12) of the recording element substrate 200 while ejecting the first sealant 400 from the needle. Likewise, the dispensing end of the needle is moved from B' to B to apply the first sealant 400. Since the first sealant 400 used has a comparatively good flowing property, it flows to an area below leads 301. Thus, boundary sealing is performed. Then, the second sealant 500 is applied on the leads 301 and the first sealant 400. The first sealant 400 and second sealant 500 are thermally cured. A liquid-ejecting recording head for which such sealing is performed is described in Japanese Patent No. 3592172.

In recent years, there has been a demand for recording apparatuses having a decreased size in the market. Decreasing the size of a liquid-ejecting recording head by narrowing the width of a tank case is effective in meeting such a demand. As the width of the tank case has been reduced in such an attempt to reduce the size of a liquid-ejecting recording head, the distance between a recording element substrate and an electrical wiring member has accordingly been reduced. Therefore, application of a sealant has become difficult. In particular, in a case where the sealant is applied using a needle as described above, application of the sealant becomes difficult since the dispensing end of the needle cannot move into a gap between the recording element substrate and the electrical wiring member.

SUMMARY OF THE INVENTION

A method of producing a recording head including a substrate provided with an element that generates energy utilized for ejecting a liquid, a wiring member that is connected to the substrate, and a supporting member that supports the recording element substrate and the wiring member includes the method applying a sealant to a region existing between a side surface of the substrate and the supporting member through a communicating path that connects the region to an outer peripheral area of the supporting member. At least part of the communicating path is provided with a sealant.

Further features of the present invention will become apparent from the following description of exemplary embodiments with reference to the attached drawings.

DESCRIPTION OF THE EMBODIMENTS

Embodiments according to the present invention will be described below on the basis of the drawings.

First Embodiment

Figure 1A:
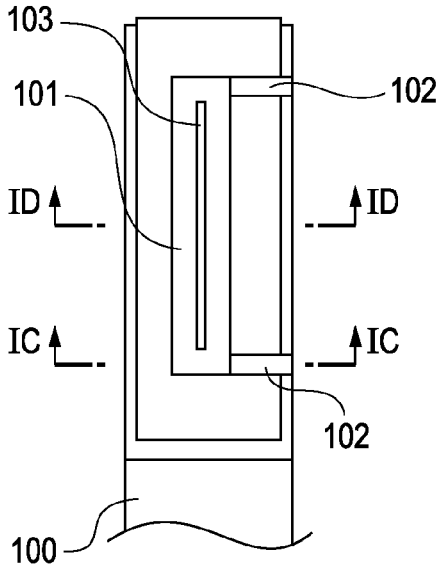
FIGS. 1A to 1D illustrate a first embodiment according to the present invention.

FIGS. 1A to 1D illustrate a first embodiment of the present invention. FIG. 1A is a plan view illustrating part of a tank case 100 serving as a supporting member. A depression 101 is provided in a central portion of the tank case 100. The depression 101 includes an adhesion surface to which a recording element substrate 200, which has an energy generating element for generating energy utilized to discharge a liquid, is fixed by adhesion. In addition, an ink-supplying port 103, which serves as a channel to supply ink, is formed near a central portion of the depression 101.

In the first embodiment, communicating paths 102 are formed in the tank case 100 to provide communication between the depression 101 and an outer peripheral area of the tank case 100. Although it is sufficient to provide one or more communicating paths 102 in the tank case 100, the communicating paths 102 can be provided near leads 301, which constitute electrical connection portions and are formed near the ends of the recording element substrate 200, so that sealing can be performed in a stable manner as described below. Therefore, in this embodiment, the communicating paths 102 are provided at positions near the longitudinal ends of the depression 101.

Figure 1B:
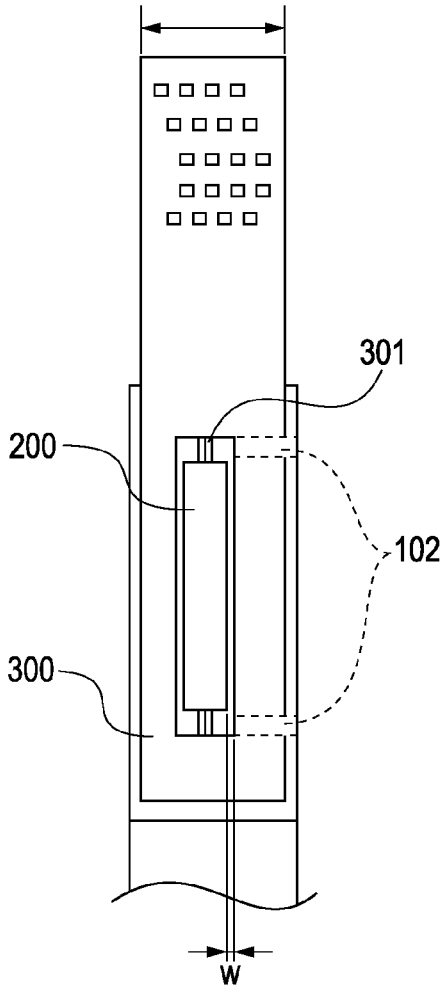
Figure 1C:
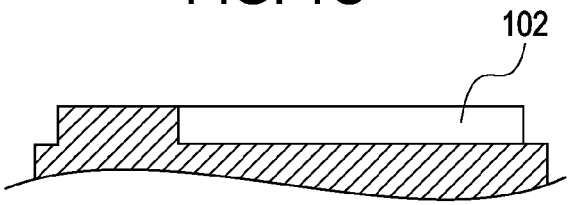
Figure 1D:
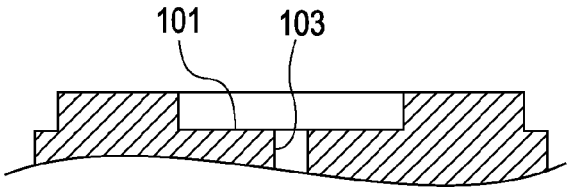

FIG. 1B is a plan view illustrating a configuration where an electrical wiring member 300 and the recording element substrate 200, which are electrically connected to each other in advance by the inner lead bonding (ILB) process in which heat and load are applied, are mounted in the tank case 100. In the mounting process, highly accurate adhesion is performed in order to fix the electrical wiring member 300 and the recording element substrate 200 to the tank case 100. In addition, the tank case 100 of the present invention is about 10 mm in width, which is about less than half the width of an existing tank case. Along with the above reduction of the width, gaps between the recording element substrate 200 and the electrical wiring member 300 (denoted by "w" in FIG. 1B) have also been reduced. In FIG. 1B, the communicating paths 102 are communicating paths that connect the depression 101 to the outer peripheral area of the tank case 100 by penetrating through the tank case 100. Each of the communicating paths 102 is constituted as an area defined by a groove formed in the tank case 100 and the electrical wiring member 300. Alternatively, such communicating paths can be through-holes formed in the tank case 100 itself.

As described above, in the first embodiment, each of the communicating paths 102 is constituted as an area defined by a groove formed in the tank case 100 and the electrical wiring member 300. The communicating path 102 is provided at two positions, that is, at both longitudinal ends of the depression 101 provided in the tank case 100.

Figure 2A:
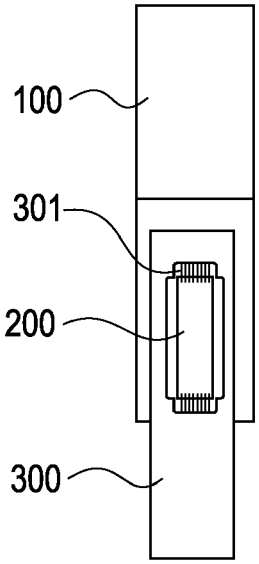
FIGS. 2A to 2C are schematic diagrams illustrating a sealing step for a liquid-ejecting recording head according to the present invention.
Figure 2B:
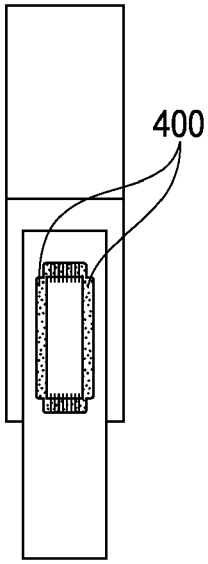
Figure 2C:
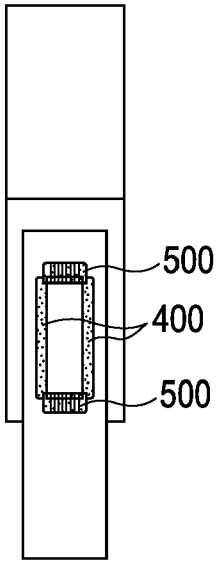

Next, a sealing method used in manufacturing the liquid-ejecting recording head of the present invention will be described. As illustrated in FIGS. 2A to 2C, in a sealing step, first, boundary sealing using a first sealant 400 is performed to seal an area surrounding the recording element substrate 200, and then ILB sealing using a second sealant 500 is performed to seal the electrical connection portions as described above. FIG. 2A is a schematic plan view illustrating a state before sealing is performed. FIG. 2B is a schematic plan view illustrating a state after the boundary sealing around the recording element substrate 200 is performed. FIG. 2C is a schematic plan view illustrating a state after the ILB sealing is performed.

Figure 3A:
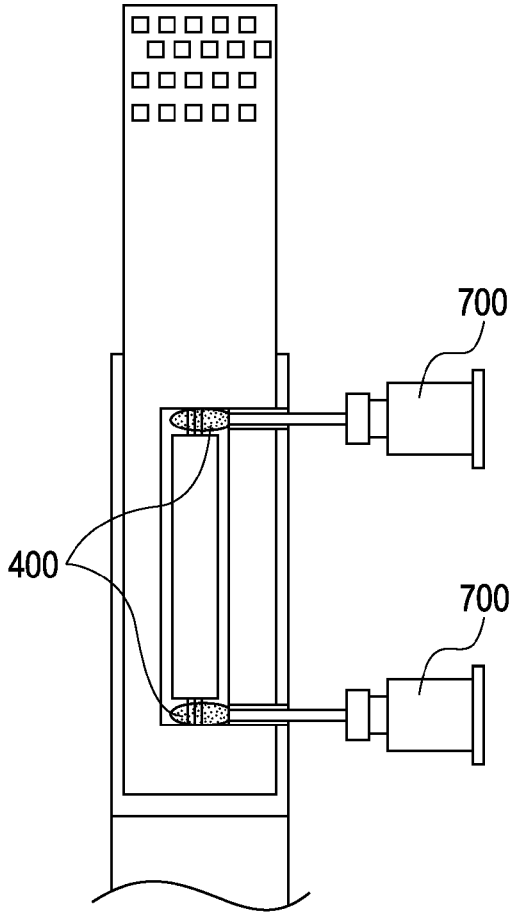
FIGS. 3A and 3B are schematic diagrams illustrating how boundary sealing is performed around a recording element substrate of the liquid-ejecting recording head according to the present invention.

FIG. 3A is a schematic diagram illustrating how the boundary sealing, in which the first sealant 400 is applied, is performed around the recording element substrate 200. In FIG. 3A, part of the electrical wiring member 300 is partially cut away in order to make the description easier. Needles 700, each of which is attached to a syringe in which the first sealant 400 is contained, are inserted into the communicating paths 102 from a side of the tank case 100. The needles 700 are selected so that each of the needles 700 has an outer shape smaller in cross-sectional area than that of each communicating path 102. In FIG. 3A, the communicating paths 102 are provided at the longitudinal ends of a device hole of the electrical wiring member 300 so that the dispensing ends of the needles 700 can be arranged close to areas near the leads 301 that constitute the electrical connection portions. In applying the first sealant 400, although it is possible to cause one needle to apply the first sealant 400 through both of the communicating paths 102 in a program of a dispenser apparatus, the first sealant 400 can be applied using two needles as illustrated in FIG. 3A to efficiently perform sealing.

Figure 3B:
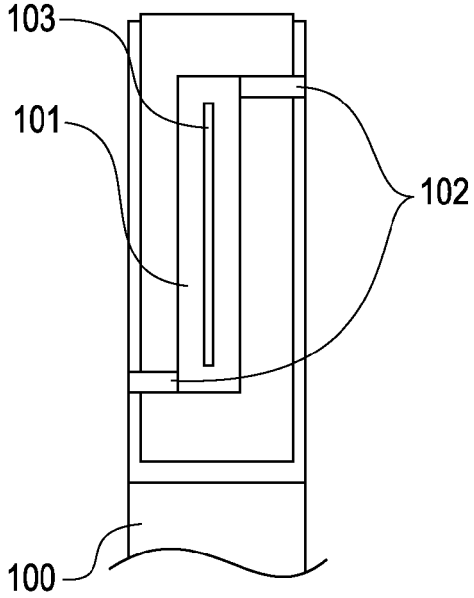

Alternatively, the communicating paths 102 can be arranged at diagonal corners of the depression 101 as illustrated in FIG. 3B. By doing this, the space of the dispenser apparatus can be allocated without mutual interference of sealant applying devices. Therefore, simultaneous application using the two needles 700 can be performed.

Figure 4A:
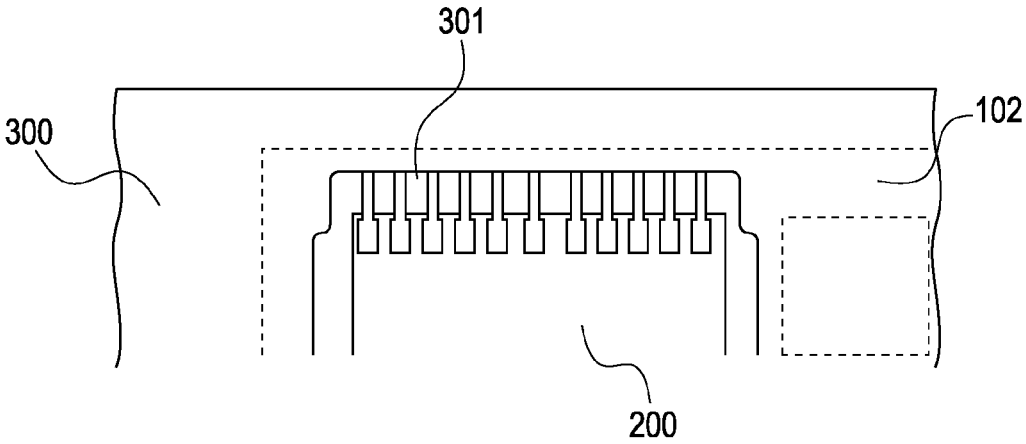
FIGS. 4A to 4C are schematic diagrams illustrating in detail how the boundary sealing is performed around the recording element substrate of the liquid-ejecting recording head according to the present invention.

Next, how the first sealant 400 is applied according to the present invention will be described in detail with reference to FIGS. 4A to 4C. FIG. 4A is a partial plan view illustrating the electrical connection portion before the first sealant 400 is applied. The recording element substrate 200 and the electrical wiring member 300 are electrically connected to each other through leads 301.

Figure 4B:
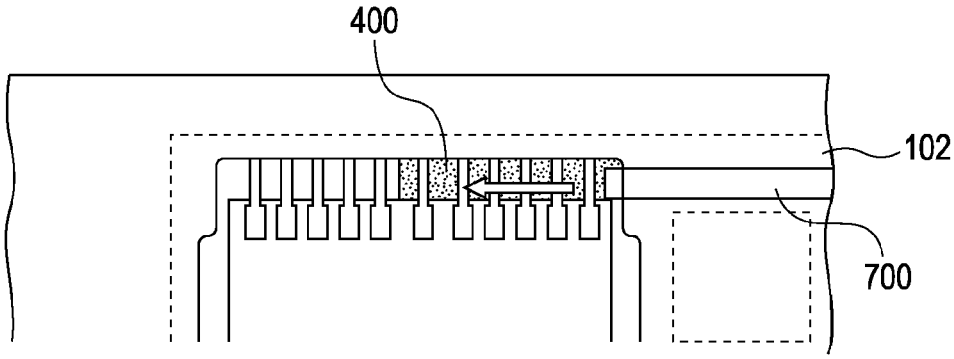
Figure 4C:
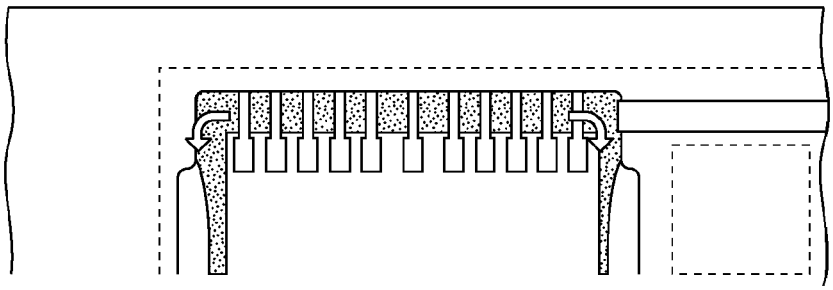

FIG. 4B is a schematic plan view illustrating a state during application of the first sealant 400.

The dispensing end of the needle 700, which is attached to a syringe in which the first sealant 400 is contained, is inserted from outside of the communicating path 102 toward the depression 101 and positioned in the vicinity of the electrical connection portion. The first sealant 400 is injected under a predetermined pressure. Since the first sealant 400 is highly flowable, it smoothly spreads along the direction indicated by the arrow in the figure gradually from the side close to the dispensing end of the needle 700. With regard to the height direction, the electrical connection portion is completely filled with the first sealant 400 gradually from the bottom toward the top with respect to the direction of gravitational force. Here, due to surface tension, the first sealant 400 filled between neighboring leads 301 first rises up to a height where the leads 301 are formed. Then, the first sealant 400 is maintained in a shape under a condition where the surface tension is balanced with the weight of the first sealant 400 itself are balanced. Thus, an area below the leads 301 facing the depression 101 is filled with the first sealant 400. Furthermore, as illustrated by the arrows in FIG. 4C, while the area below the leads 301 facing the depression 101 is filled with the first sealant 400, the first sealant 400 also spreads in the longitudinal direction of the recording element substrate 200 while forming menisci with the recording element substrate 200 and the electrical wiring member 300.

Figure 5:
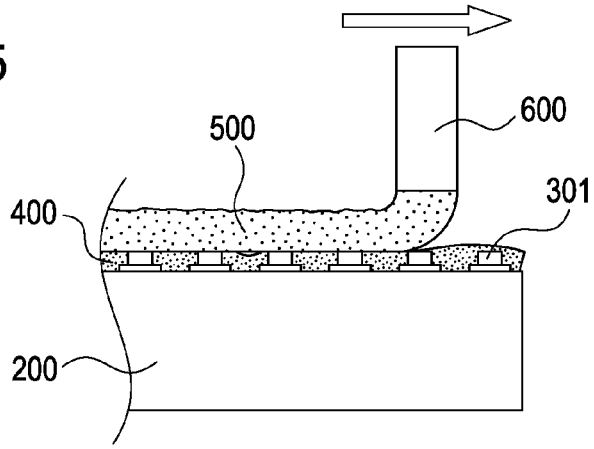
FIG. 5 illustrates how ILB sealing is performed for the liquid-ejecting recording head according to the present invention.
Figure 6A:
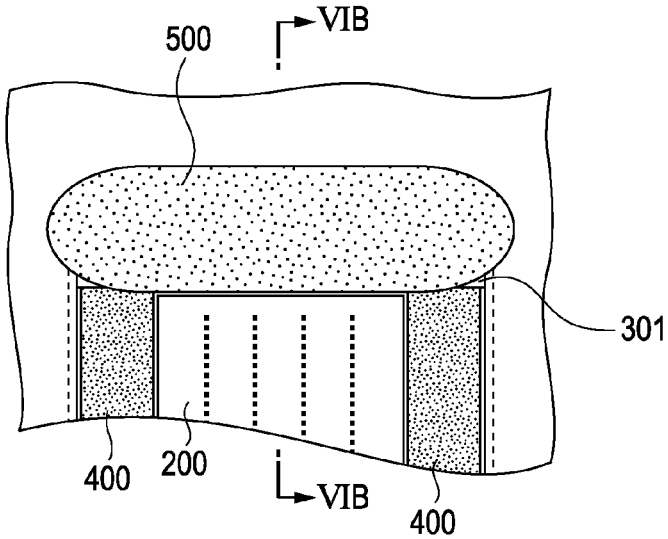
FIGS. 6A and 6B are schematic diagrams illustrating how sealing is performed for the liquid-ejecting recording head according to the present invention.
Figure 6B:
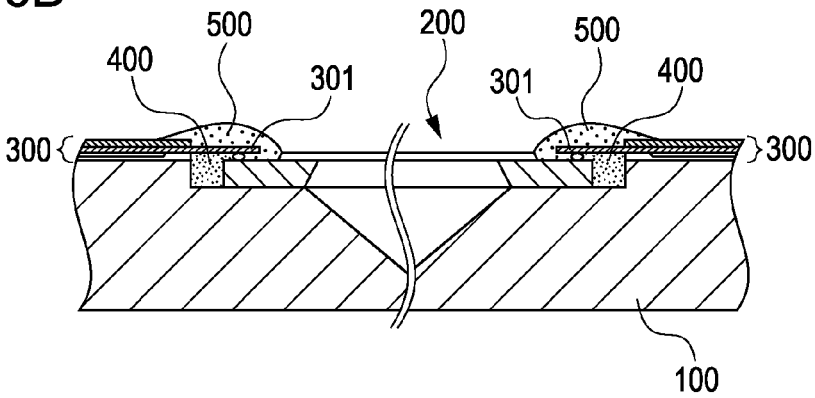

Thus, after filling with the first sealant 400 is performed, the ILB sealing is performed using the second sealant 500. FIG. 5 is a schematic side view illustrating a state where the ILB sealing is performed using the second sealant 500. While a dispensing end of a needle 600 attached to a syringe in which the second sealant 500 is contained moves in a direction denoted by the arrow in FIG. 5, the second sealant 500 is applied on the leads 301 and the first sealant 400. FIGS. 6A and 6B illustrate a state where the first sealant 400 and the second sealant 500 have been applied. As described above, the electrical connection portions are completely filled with the first sealant 400, which has been applied in advance, due to capillary force. In addition, the second sealant 500 is applied on the first sealant 400. Therefore, the electrical connection portions including the leads 301 are sealed without being exposed as illustrated in FIGS. 6A and 6B.

When sealing using the first sealant 400 and the second sealant 500 is complete as described above, the resultant structure is thermally cured. The liquid-ejecting recording head can be constructed using a recording element substrate unit structured as described above.

As described above, a characteristic of this embodiment is that the liquid-ejecting recording head includes the communicating paths 102 that connect the depression 101 provided in the tank case 100 to the outer peripheral area of the tank case 100. With this configuration, a need to secure an area between the recording element substrate 200 and the electrical wiring member 300 to accept the needles 700 is eliminated, thereby allowing the tank case 100 and the electrical wiring member 300 to be reduced in size. Accordingly, the width of the tank case 100 can be reduced and, as a result, a reduction in size of the liquid-ejecting recording head can be achieved.

In addition, with the liquid-ejecting recording head of the present invention, the sealant can be applied directly in the vicinity of the electrical connection portions by inserting the needles 700 through the communicating paths 102. Therefore, there is no need to set flowing time for the sealant as needed in an existing case, thereby allowing filling with the sealant to be performed in a shorter time. Thus, production efficiency is improved. In addition, since there is no need to enlarge an opening of the electrical wiring member 300, the electrical wiring member 300 can be reduced in size without limitations which might otherwise be imposed by wiring width, the number of wires, and the like of the electrical wiring member 300.

Second Embodiment

Figure 7:
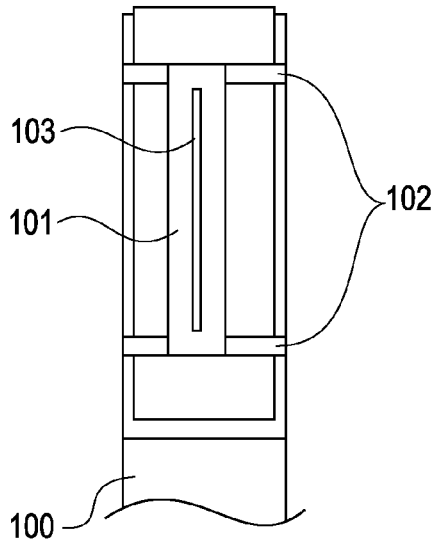
FIG. 7 illustrates a second embodiment according to the present invention.

FIG. 7 is a schematic plan view illustrating a second embodiment of the present invention. The second embodiment differs from the above embodiment in that the tank case 100 includes, in total, four communicating paths 102 which provide communication between the depression 101 provided in the tank case 100 and the outer peripheral area of the tank case 100. The four communicating paths 102 are provided at opposing positions at both longitudinal ends of the depression 101.

In this embodiment, a sealant can simultaneously be applied from both sides along the direction in which the electrical connection portions including the leads 301 are arranged, thereby allowing sealing to be efficiently performed in a balanced manner in the left-right direction. In addition, since a plurality of the needles 700 can be used to apply the sealant through a plurality of the communicating paths 102 at the same time, there is no need to set the flowing time as needed in the existing case. Thus, sealing can be performed in a shorter time, and accordingly, production efficiency can be improved.

Third Embodiment

Figure 8A:
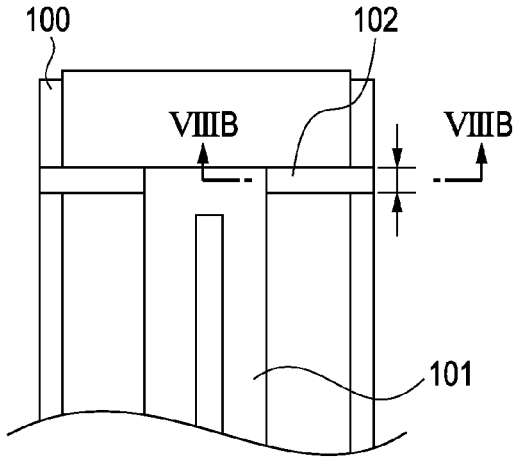
FIGS. 8A and 8B illustrate a third embodiment according to the present invention.
Figure 8B:
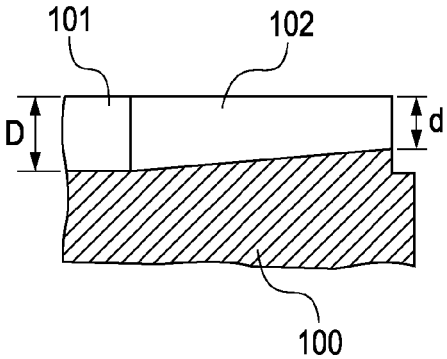

FIGS. 8A and 8B are schematic plan views illustrating a third embodiment of the present invention. FIG. 8A is a schematic plan view illustrating the tank case 100 according to the third embodiment of the present invention. FIG. 8B is a cross-sectional view of the tank case 100 taken along line VIIIB-VIIIB in FIG. 8A. In each of the communicating paths 102 of this embodiment, the depth of an opening (first opening) provided in an position neighboring and facing the depression 101 (denoted as D in FIG. 8B) is larger than the depth of the other opening (second opening) provided in a position neighboring and facing the outer peripheral area of the tank case 100 (denoted as d in FIG. 8B). In other words, the bottom surface of the second opening is located above the level of the bottom surface of the first opening in the vertical direction.

In this embodiment, the bottom surface of each of the communicating paths 102 is inclined such that the bottom surface ascends gradually from the opening facing the depression 101 of the tank case 100 toward the other opening facing the outer peripheral area of the tank case 100. Therefore, in terms of the gravitational force that acts on the sealant, this configuration is effective in preventing the sealant from overflowing toward the outer peripheral area of the tank case 100. This allows the sealant to flow with the head facing upward (discharge ports are directed upward) in a curing step performed to heat and cure the sealant. In addition, a sealant can simultaneously be applied from both sides along the direction in which the electrical connection portions including the leads 301 are arranged, thereby allowing sealing to be efficiently performed in a balanced manner in the left-right direction.

Furthermore, since a plurality of needles 700 can be used to apply the sealant through a plurality of the communicating paths 102 at the same time, there is no need to set the flowing time as needed in the existing case, thereby allowing filling with the first sealant 400 to be performed in shorter time. Thus, production efficiency is also improved.

Fourth Embodiment

Figure 9:
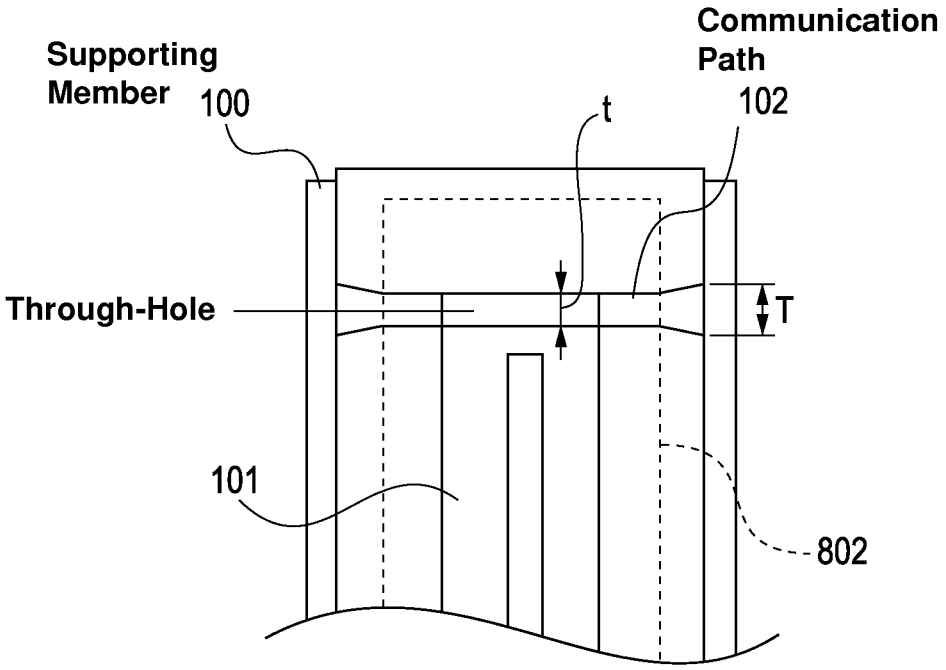
FIG. 9 illustrates a fourth embodiment according to the present invention.
Figure 10A:
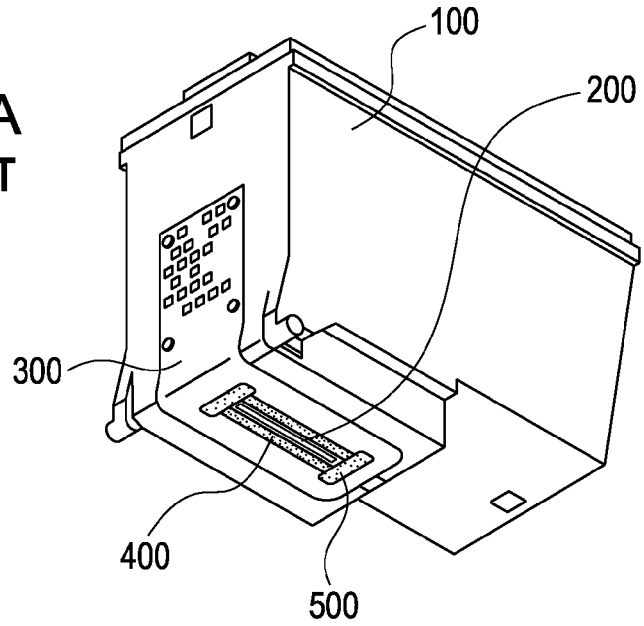
FIG. 10A PRIOR ART
FIGS. 10A and 10B are schematic perspective views illustrating an existing liquid-ejecting recording head.
Figure 10B:
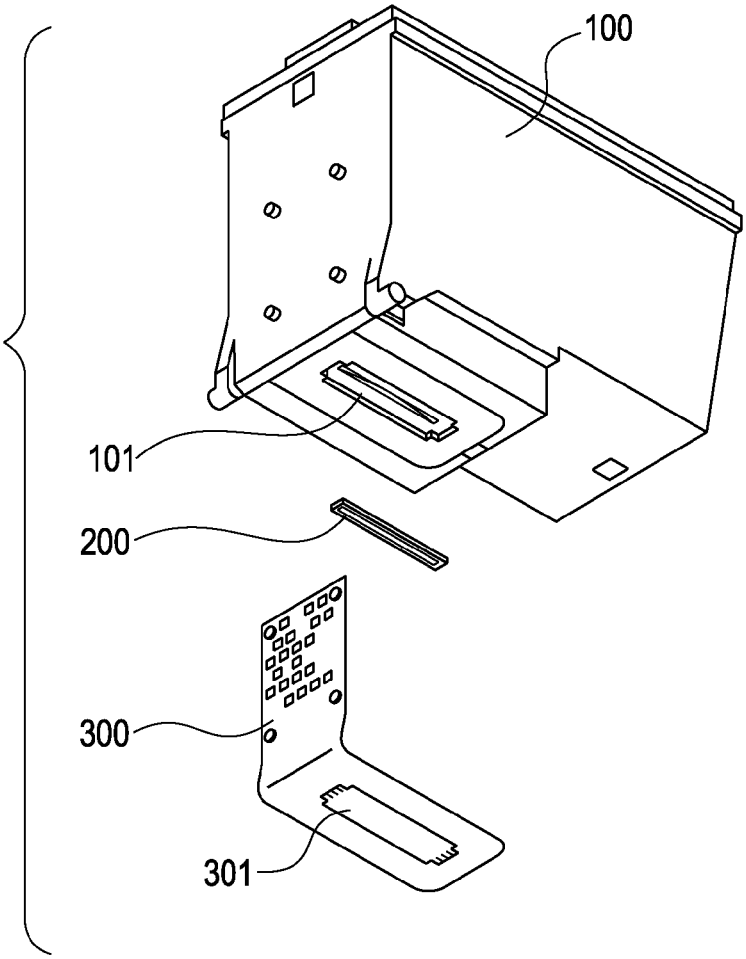
FIG. 10B PRIOR ART
Figure 11A:
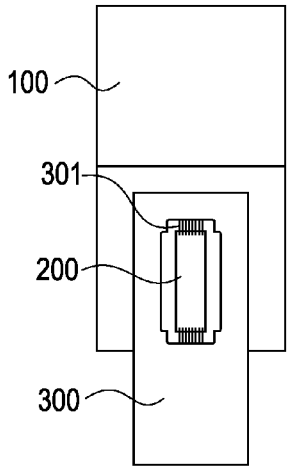
FIG. 11A PRIOR ART
FIGS. 11A to 11C are schematic diagrams illustrating sealing steps used for the existing liquid-ejecting head.
Figure 11B:
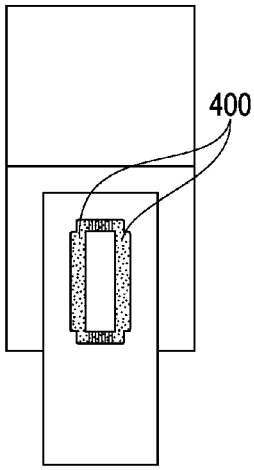
FIG. 11B PRIOR ART
Figure 11C:
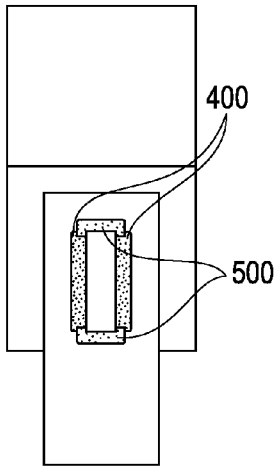
FIG. 11C PRIOR ART
Figure 12:
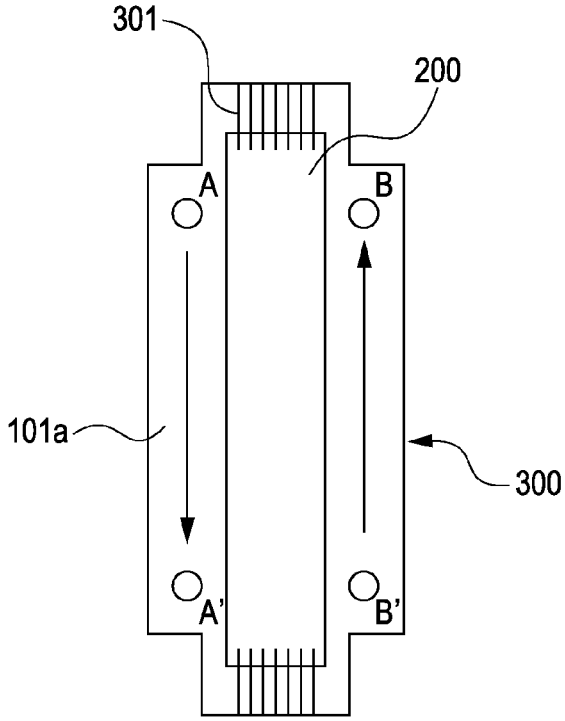
FIG. 12 PRIOR ART
FIG. 12 is a schematic diagram illustrating the sealing steps used for the existing liquid-ejecting head.

FIG. 9 is a schematic plan view illustrating a fourth embodiment of the present invention. In each of the communicating paths 102 of this embodiment, an area of an opening facing the depression 101 provided in the tank case 100 (denoted as t in FIG. 9) is smaller than an area of the other opening facing the outer peripheral area of the tank case 100 (denoted as T in FIG. 9). The communicating paths 102 are formed such that a cross-sectional area of each communicating path 102 is constant in a predetermined range from a position where the communication path 102 faces the depression 101 of the tank case 100, and then is gradually increased toward an outer peripheral area of the tank case 100.

The liquid-ejecting recording head according to the present invention performs an ink recovery process to supply the ink to discharge ports. Generally in this process, capping is performed by pressing a cap formed of an elastic material against an electrical wiring member 300. Referring to FIG. 9, a capping area 802 indicates an area in which the cap is brought into contact with the electrical wiring member 300. In this area, the elastic material and the electrical wiring member 300 come into contact with each other to cover an area including a group of discharge ports provided in the recording element substrate 200. In such a case, flatness and a tight sealing property are used so that the capping member is pressed against the electrical wiring member 300 in the capping area 802 without a gap. For that purpose, the flatness in the capping area 802 can be ensured by filling the inside of the communicating paths 102 in the capping area 802 with a sealant.

In this embodiment, the cross-sectional areas of the communicating paths 102 are small in the capping area 802, but are gradually increased toward the outer peripheral area of the tank case 100 in areas outside the capping area 802. By doing this, the sealant is held by meniscus force in each of the communicating paths 102 in the range where the cross-sectional area is small. Therefore, overflowing of the sealant toward the outer peripheral area of the tank case 100 can be prevented.

As described above, in this embodiment, suction using the cap can be performed in a stable manner by filling the communicating paths 102 in the capping area 802 with the sealant. In addition, there is another effect in which overflow of the sealant toward the outer peripheral area of the tank case 100 is prevented.

Each of the embodiments described above is structured such that the tank case 100 itself serves as the supporting member. However, the present invention is not limited to such a structure and is applied to a structure, for example, where a recording element substrate can be provided on a supporting plate composed of alumina or the like and provided in a tank case composed of a polymer or the like. In such a case, the communicating paths can be provided in the supporting plate.

Furthermore, according to the present invention, the sealant can be applied using the needle through the communicating path from the peripheral side of the supporting member. Therefore, stable sealing can be performed even when a gap between the electrical wiring member and the recording element substrate is narrowed along with reduction of the size of the liquid-ejecting recording head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-267729 filed Nov. 25, 2009, which is hereby incorporated by reference herein in its entirety.

What is claimed is:

1. A recording head comprising:

a substrate provided with an element that generates energy utilized for ejecting a liquid;

a wiring member connected to the substrate;

a supporting member that supports the substrate and the wiring member, the supporting member including a depression in which the substrate is placed; and a communicating path that connects a region existing between a side surface of the substrate and an inner side surface of the depression to an outer peripheral area of the supporting member, wherein at least part of the communicating path is provided with a sealant.

2. The recording head according to claim 1, wherein the communicating path is constituted by an area defined by a groove formed in the supporting member and the wiring member.

3. The recording head according to claim 1, wherein the communicating path is constituted by a through-hole formed in the supporting member.

4. The recording head according to claim 1, wherein a first opening of the communicating path, the first opening facing the region, is formed near a longitudinal end of the substrate.

5. The recording head according to claim 1, wherein an area of a second opening of the communicating path, the second opening facing the outer peripheral area, is larger than an area of a first opening of the communicating path, the first opening facing the region.

6. The recording head according to claim 1, wherein a bottom surface of a second opening of the communicating path, the second opening facing the outer peripheral area, is located above a level of a bottom surface of a first opening of the communicating path, the first opening facing the region, in a vertical direction, and an area of the second opening is smaller than an area of the first opening.

* * * * *